US005575518A

United States Patent [19]

Payne

[11] Patent Number: 5,575,518

[45] Date of Patent: Nov. 19, 1996

[54] GRIPPER TOOL FOR HANDLING LUMBER

[76] Inventor: Douglas F. Payne, P.O. Box 582, Wellsriver, Vt. 05081

[21] Appl. No.: 358,377

[22] Filed: Dec. 19, 1994

[51] Int. Cl.[6] ..... B25B 5/14

[52] U.S. Cl. ..... 294/16; 294/118; 269/41

[58] Field of Search ..... 294/3, 16, 28, 294/30, 31.1, 62, 104, 118; 81/44, 332, 420, 421; 269/41, 42, 155, 238

[56] References Cited

U.S. PATENT DOCUMENTS

| | | | |
|---|---|---|---|
| 831,264 | 9/1906 | Charnock | 81/332 |
| 956,910 | 5/1910 | Veiox | 294/118 |
| 1,822,294 | 9/1931 | Johnson | 294/118 |
| 2,967,730 | 1/1961 | Vann | 294/31.1 |
| 3,102,507 | 9/1963 | Jergitsch | 294/104 |
| 3,617,044 | 11/1971 | Strange | 81/420 |
| 3,645,577 | 2/1972 | Peper | 294/118 |
| 4,165,869 | 8/1979 | Williams | 269/41 |
| 4,340,100 | 7/1982 | Anderson, II | 269/41 |

*Primary Examiner*—Dean Kramer
*Attorney, Agent, or Firm*—Spencer E. Olson

[57] ABSTRACT

A gripper tool for facilitating the handling of framing lumber of two inches by four or more inches cross-section used as studs and joists, includes a pair of pivotally joined levers having longer arms at one side of the pivot constituting handles and shorter arms at the other side of the pivot. A first of the shorter arms has a portion which extends from the pivot and at its end has a right angularly extending jaw adapted to engage one side of a lumber member, and the other shorter arm, which is pivotable relative to the first, has a jaw engageable with the opposite side of the lumber member. A thin plate affixed to the extending portion of the first shorter arm extends equidistantly to either side for providing ears adapted to temporarily support on an adjoining lumber member an end of a lumber member to which the jaws are releasably clamped. An optional spring, pivotably attached to the flat plate, is shaped and dimensioned to lock the clamped tool onto an abutting lumber member of the same thickness.

20 Claims, 3 Drawing Sheets

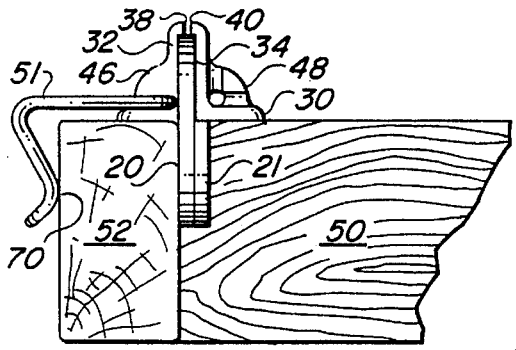
FIG. 2
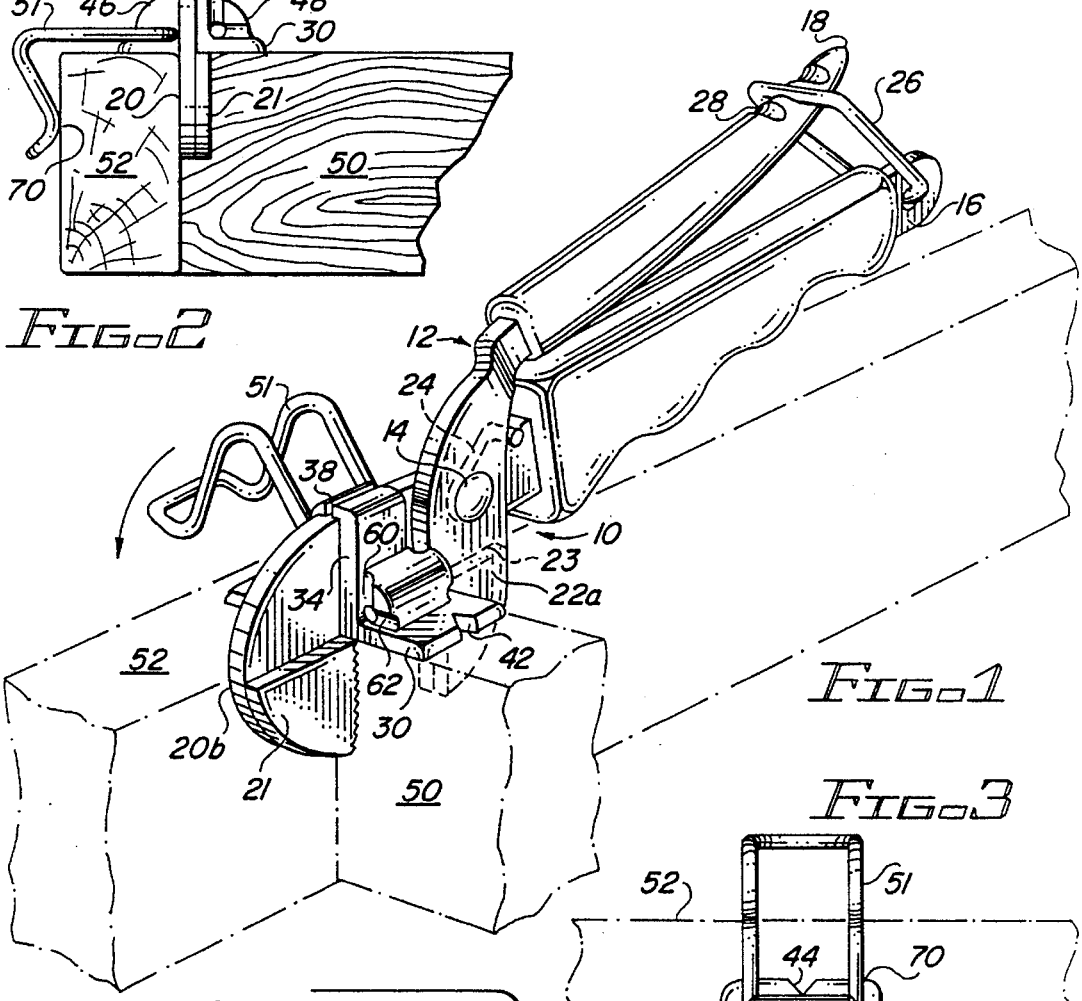
FIG. 1
FIG. 3
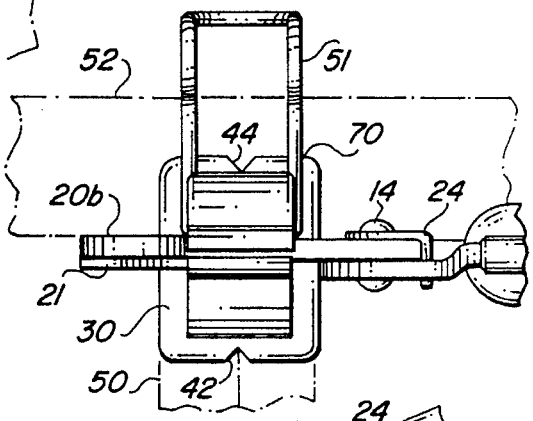
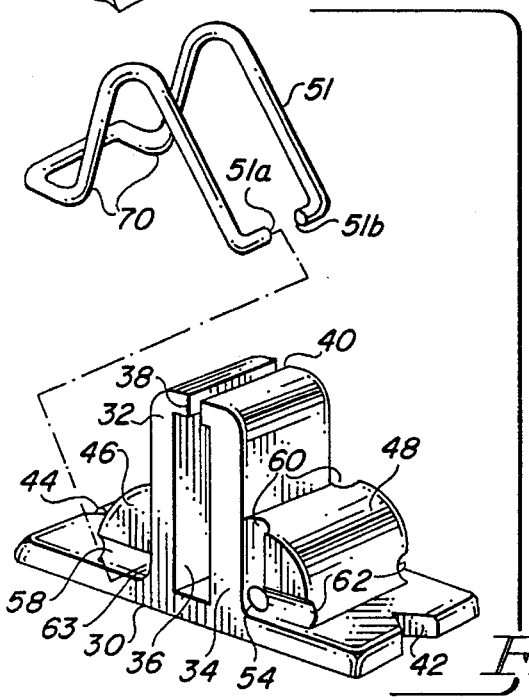
FIG. 4
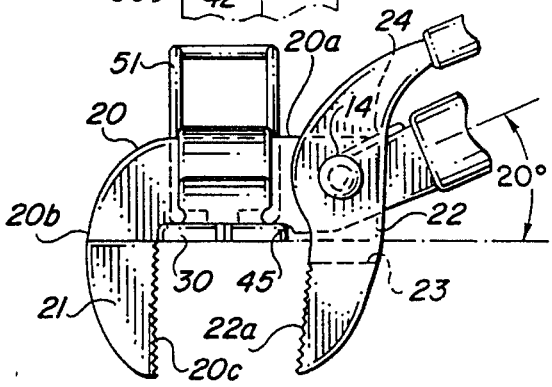
FIG. 1A

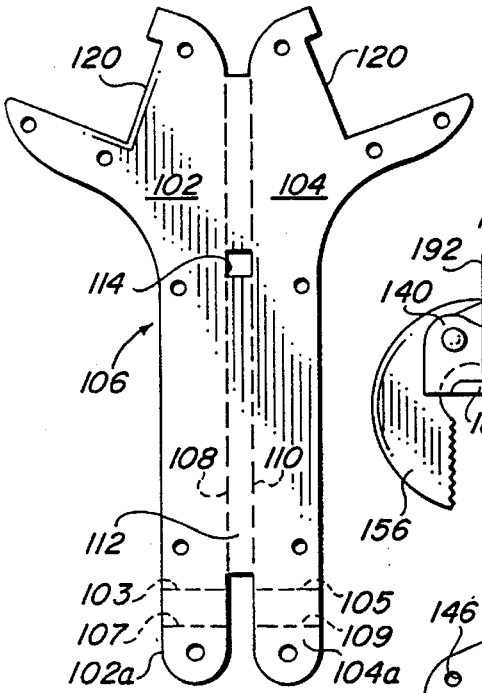
FIG. 5
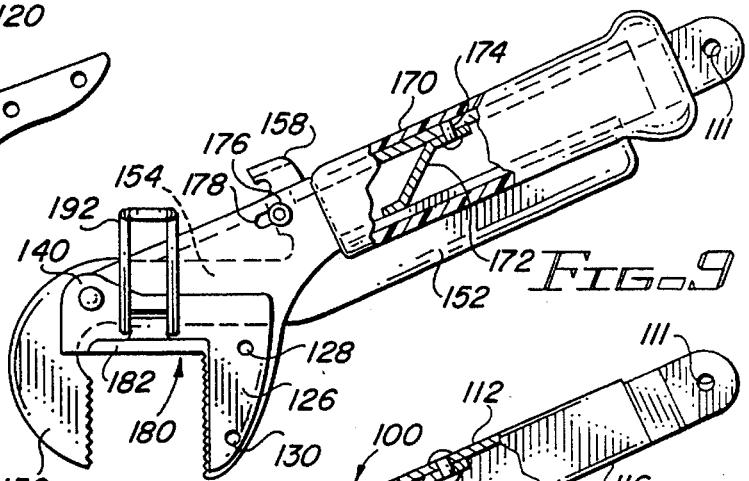
FIG. 9
FIG. 8
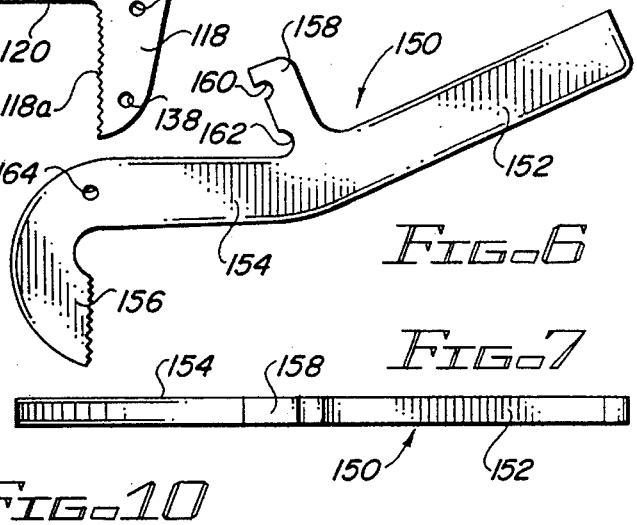
FIG. 6
FIG. 7
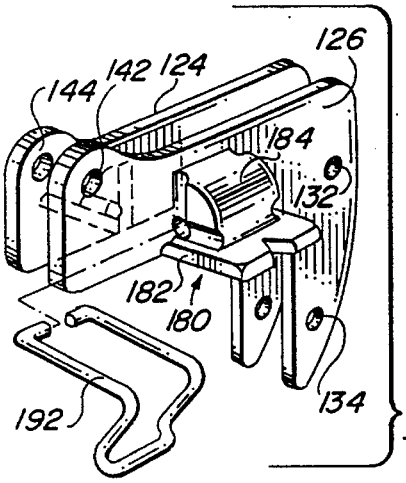
FIG. 10
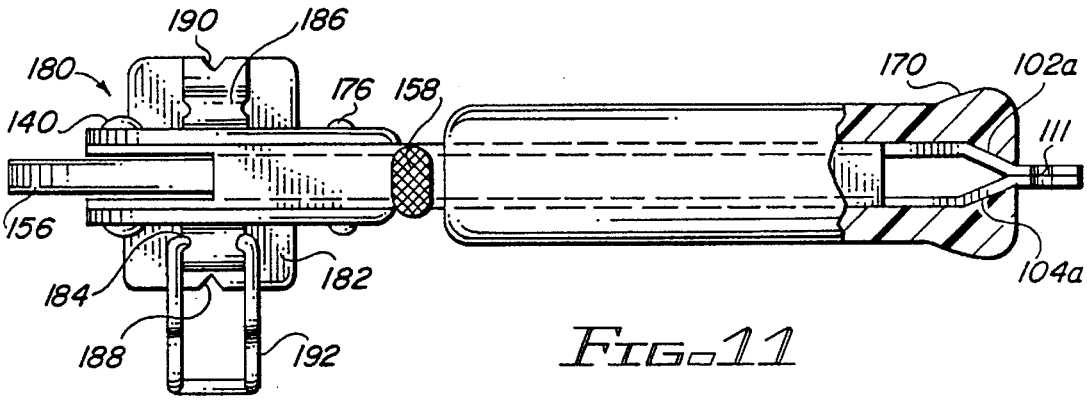
FIG. 11

GRIPPER TOOL FOR HANDLING LUMBER

BACKGROUND OF THE INVENTION

This invention relates generally to hand tools and, more particularly, is directed to a hand-held gripper tool constructed especially to fit lumber members of the size used for construction of wooden structures, for temporarily supporting them on other members, or for forcibly twisting them into desired position for nailing.

Wood-framing forms the basic supporting structure for the walls, floors and the roof and includes the sill which runs around the perimeter of the building and is bolted to the top of the foundation; floor joists, usually cut from eight-by-ten stock, set horizontally and on edge with their ends supported on opposite sills for supporting a subfloor; header joists at right angles to the floor joists and nailed to the top of the sill; sole plates that extend around the perimeter of the subfloor and nailed to the header joists; and vertical stud members, usually cut from two-by-four stock and usually spaced sixteen inches apart from center to center. The bottom end of the stud is secured to the sole plate by "toe-nailing" at an angle through the stud into the plate, the carpenter usually holding the stud with his/her foot or free hand to keep it from slipping while nails are driven into each side. The upper end of the stud is nailed in similar fashion to a top plate which supports the joists for an upper story. Typically, the lumber is either two-by-four or two-by-six having a standard thickness of 1½ inches, and the various members are nailed together using either a hammer or a pneumatic nail gun. The lumber is maneuvered into place by hand, and as previously noted, is held in place for nailing with one hand while nailing with the other.

Apart from the wrist fatigue caused by repeated handling and holding two-by-fours or two-by-sixes in place, the free hand holding a joist in position for nailing to an adjoining member winds up in the path of the nails, thus exposing the hand to risk of being pierced, the risk increasing when a nail gun is being used. Another problem involved in wood-framing lies in the difficulty in holding one end of a joist at the proper location for nailing while the other end is being positioned; this problem is especially vexing to the "do-it-yourselfer" who may have to work alone. Also, it is frequently necessary to exert torque or twisting force on a warped piece of lumber two-by-four or more inches cross section into proper position for nailing. Prior tools have lacked the capability to conveniently handle such twisting and lacked other features of the tool described herein.

It is accordingly a primary object of the present invention to provide solutions to the above problems and difficulties, and also to provide a unique tool having multiple capabilities, for handling wooden lumber members.

Another object of the invention is to provide a tool for gripping and positioning standard two-by-lumber for nailing which keeps the hands of the user away from the nail path.

Another object is provide a tool for gripping and handling wooden lumber members which gives the user an extended reach and a more comfortable and efficient holding position, out of the nail path.

Another important object is to provide a gripping tool adapted to temporarily support an end of a lumber member in position for nailing.

Still another object of the invention is to provide a tool capable of exerting a twisting force on a wooden lumber member.

SUMMARY OF THE INVENTION

Briefly, the gripper tool according to the invention includes a pair of pivotally joined levers having longer arms at one side of the pivot, which serve as handles, and shorter arms at the other side of the pivot disposed closely parallel to one another. A first of the shorter arms has a portion which extends from the pivot a distance generally corresponding to standard lumber thickness and at its end has a generally right angularly extending jaw. The second of the shorter arms has a jaw thereon which opposes and is spaced from the other jaw a distance slightly greater than the lumber thickness. The jaws are closed by pressing the handles together to firmly grip a piece of lumber placed therebetween. The free ends of the handles may be releasably locked together whereby the tool may be firmly clamped to a piece of lumber even though the user releases his/her hold on the handles. The shorter arms are closely adjacent each other so as to enable the tool to grip a lumber member very close to an end. A plate affixed to the extending portion of the first of the shorter arms and extending perpendicularly and equidistantly to either side of the arm provides ears adapted to support the end of the joist in position on an adjoining member. One tool at each end will temporarily support both ends of a member, leaving both hands of the user free for nailing. An optional spring, pivotally attached to the flat plate, is shaped and dimensioned to lock the end of the member to which the tool is clamped onto an abutting member of the same thickness.

BRIEF DESCRIPTION OF THE DRAWINGS

Other objects, features and advantages of the invention will become apparent, and its construction and operation better understood, from the following detailed description taken in conjunction with the accompanying drawings, in which:

FIG. 1 is a perspective view of one embodiment of the gripper tool in operation;

FIG. 1A is a fragmentary elevation view showing the jaws of the tool;

FIG. 2 is an elevation end view of the gripper tool as viewed from the left in FIG. 1;

FIG. 3 is a fragmentary plan view of FIG. 1;

FIG. 4 is an exploded perspective view showing construction details of the tool;

FIG. 5 is a plan view of a stamping used to form a first handle and a first jaw of a second embodiment of the gripper tool;

FIG. 6 is a plan view of a stamping used to form a second handle and a second jaw of the second embodiment;

FIG. 7 is a top plan view of FIG. 6;

FIG. 8 is a side elevation view, partly cut away, of the first handle and jaw;

FIG. 9 is a side elevation view, partly cut away, of the second embodiment;

FIG. 10 is an exploded perspective view of the left end of the tool as viewed in FIG. 9, with one jaw removed;

FIG. 11 is a top plan view, partly cut away, of FIG. 9; and

DETAILED DESCRIPTION OF THE PREFERRED EMBODIMENTS

Figure 12:
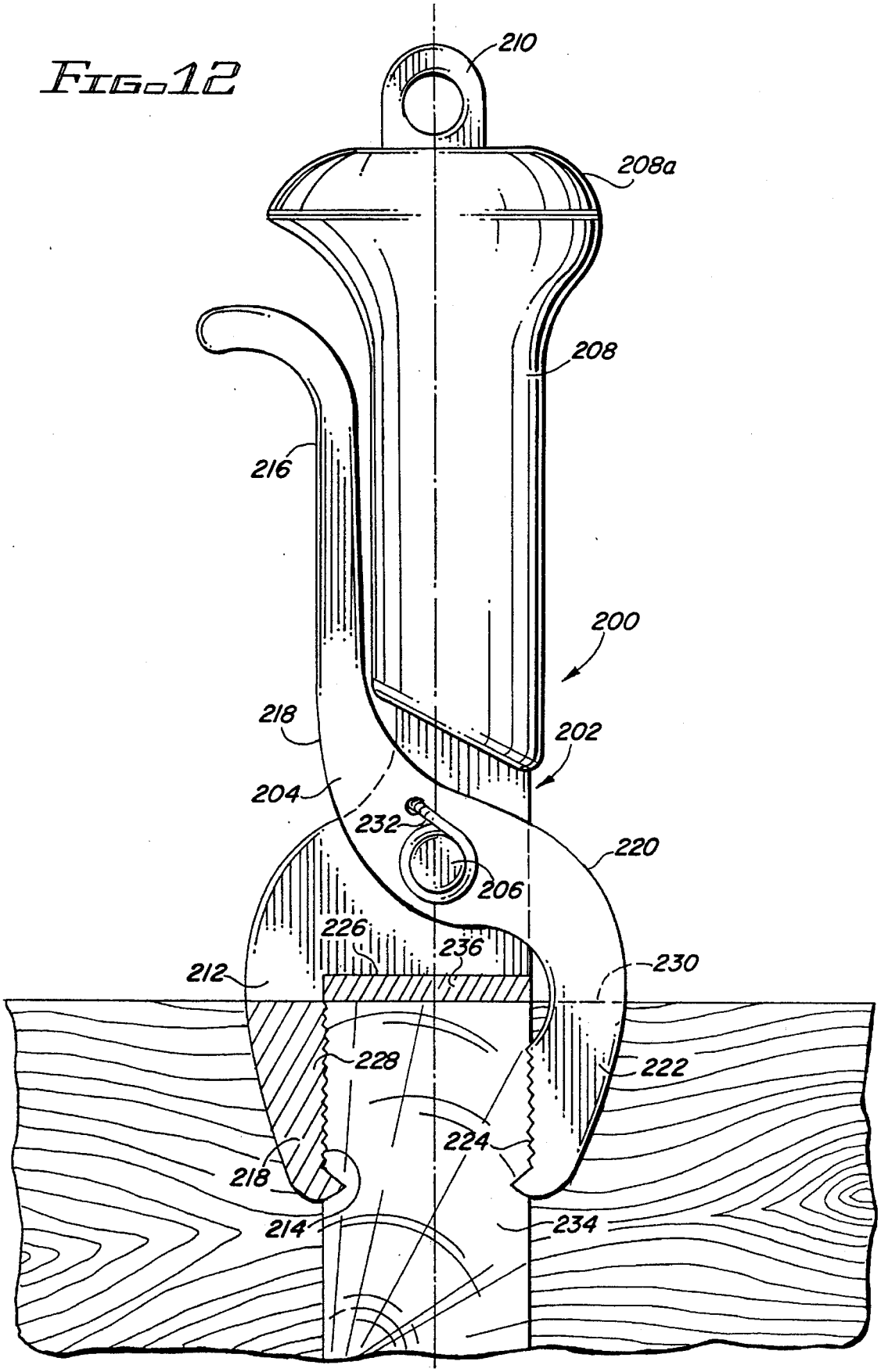
FIG. 12 is an elevation view of a third embodiment of the invention.

The embodiment of the gripper tool illustrated by FIGS. 1–4 is preferably made of flat hardened steel and includes a pair of levers 10 and 12 pivotally joined by a pivot pin 14. The levers have longer arms 16 and 18, respectively, at one side of the pivot pin constituting handles and shorter arms 20 and 22, respectively, at the other side of the pivot pin. Handle 18 is covered with rubber or similar material, preferably applied by dipping, and handle 16 has a contoured rubber grip thereon for providing comfortable handling of the tool. A spring 24, one end of which is secured by the head of pivot pin 14 to the outer surface of lever 10 and the other end of which contacts the inner edge of lever 12, urges handle 18 away from handle 16 so as to spread the jaws.

The arm 20 includes a portion 20*a* which extends forwardly from pivot pin 14 a distance approximating the standard thickness of two-by-lumber, that is, about one and one-half inches, and at its forward end has a generally right-angularly extending jaw 20*b*, the inner edge 20*c* of which is serrated. The arm 22 has a jaw portion 22*a* extending from pivot pin 14 in a direction generally parallel to the inner edge 20*c* of the other jaw. At a location slightly behind pivot pin 14, the handle portion 18 is offset from the shorter arm portion 22 by the arm thickness, typically 3/16-inch, such that handles 16 and 18 are co-planar and the confronting jaws 20*c* and 22*a* are disposed in closely adjacent parallel planes. To insure a straight bite on a lumber member without twisting, the near surface of jaw 20*b* and the far surface of jaw 22*a*, as viewed in FIGS. 1 and 1A, have respective 3/8-inch thick plates 21 and 23 attached hereto, as by welding; plate 21 extends from a point just below the inner edge of arm portion 20*a* to the tip of the jaw, and the upper edge of plate 23 is approximately 1/4-inch lower than the upper edge of plate 21 so as to provide a stop for limiting the movement of arm 18 away from arm 16. With the addition of these plates the jaws are 3/4-inch wide and directly opposed so as to firmly engage the side surfaces of a lumber member, even if gripped at the very end. Should the levers be forged instead of being fabricated from flat steel, the added jaw thickness provided by plates 21 and 23 would be built into the mold. When handle 18 is biased away from handle 16 by spring 24, the spacing between the jaws is enough greater than the standard 1½ inch lumber thickness to closely receive a lumber member therebetween, and when they are hand-squeezed toward one another, against the bias of the spring, the jaws close and firmly grip opposite side surfaces of the lumber. The jaws may be clamped to the gripped piece of lumber by locking the free ends of handles 16 and 18 together with a suitable locking mechanism, such as the illustrated elongated closed loop 26 of heavy wire pivotally coupled at one end to handle 16 and arranged to engage that one of three transverse notches 28 formed in the outer surface of handle 18, near its free end, which insures firm clamping to the lumber piece despite slight variations in thickness. Thus, the lumber piece clamped between the jaws will be firmly held even though the user lays it down with the tool clamped to it.

The inner edge of portion 20*a* of arm 20 extends between and is perpendicular to the opposing jaws and defines a throat region of a length approximating the standard lumber thickness. The longitudinal axis of handle 16 is angularly displaced from the inner edge of portion 20*a* by about 20°, and the curvature of lever 12 is such that handle 18 is generally parallel to handle 16. Applicant has found that the shape and this angular orientation of the handles relative to a lumber piece clamped between the jaws enables the user to move and handle lumber with much less wrist fatigue than when hand-grasping the lumber itself. When used to grip and position a piece of lumber, say a joist, during construction, the length of the handles, typically about six inches measured from pivot pin 14, gives the user an extended reach, placing his/her hand out of the nail path and helping maintain safe control, particularly if a pneumatic nail-driving tool is being used. Further with the jaws of the tool clamped to a piece of lumber, the handles provide the user with enhanced leverage for twisting warped lumber into place for nailing.

A feature which enables the gripper tool to temporarily support an end of a joist in position for nailing resides in the provision of a flat plate 30 in the throat region which extends substantially equidistantly to either side of and at right angles to the shorter arms. Plate 30 has a flat underside and is releasably attached, with a slide-on snap-off action, to the forwardly extending portion 20*a* of arm 20 by a pair of integral resilient stiffening members 32 and 34 which extend perpendicularly upward from the top side of plate 30 a distance slightly greater than the width of arm portion 20*a* and together define a slot 36 in which arm 20 is received with a tight fit. Opposing shoulders 38 and 40 formed on the upper ends of members 32 and 34, respectively, grip the upper edge of arm 20*a* and maintain the plate at right angles to the arm. The integral assembly of plate and stiffening members is formed of a high impact plastic material such as "Lexan", which is sufficiently strong and rigid to support one end of a two-by-eight or more joist of typical length, yet resilient enough to allow it to be slid onto and snapped off from the arm 20. In the illustrated embodiment plate 30 is rectangular in shape, being 1½ inches wide so as to fit snugly in the throat region between the jaws, 1⅞ inches long and 3/16 inch thick. Notches 42 and 44 accurately placed mid-width of the narrower edges of plate 30 are useful in aligning a clamped piece of lumber with a center line mark made on an adjoining member. As best seen in FIG. 1A, a notch 45 formed at the right end of the inner edge of arm portion 20*a* keeps plate 30 in position on the arm.

FIGS. 1, 2 and 3 illustrates an important use of the gripper tool made possible by the orientation of plate 30. The tool is shown clamped close to one end of an elongated wooden member 50 of rectangular cross-section, say a two-by-eight joist, with one ear of plate 30 lying flush along the upper edge surface of the member; the other ear of plate 30 projects beyond the end of the member 50 and rests upon a transverse elongated wooden member 52 of rectangular cross-section for temporarily supporting the joist in position for nailing connection to member 52, thus leaving both hands of the user free for nailing. A projecting tab of a second gripper tool (not shown) clamped to the other end of member 50 and resting upon another transverse member, will temporarily support the other end. In addition to providing temporary support, the planar undersurface of plate 30 insures that the upper edge of member 50 is flush with the upper surface of transverse member 52 so as to provide a good, uniform surface for plywood or decking.

In the event the member 50 to which the tool is clamped is warped, the tool may be used to twist its end into position for nailing to transverse member 52. One nail driven through transverse member 52 and into the end of member 50 acts as a pivot, and the tool forcibly rotates the end to the correct position to receive a second nail through member 52 and into the end of member 50. The opposite remote end of member 50, which may already be temporarily supported on another transverse member as described above, is similarly rigidly secured to the other transverse member.

The illustrated gripper tool has another valuable function, namely, for temporarily locking the clamped end of an elongated member 50 in abutting relationship with transverse member 52. This is accomplished with a generally rectangularly-shaped spring 51 pivotally coupled to the assembly which includes plate 30, specifically to one or the other, or both, of the integral stiffening ribs 46 and 48. Spring 51 is bent from spring steel rod stock, typically ⅛-inch in diameter, into a generally rectangular shape when viewed in plan, one of the narrow sides being defined by confronting turned-in ends 51*a* and 51*b* which can be sprung apart a distance approximating the thickness of ribs 46 and 48 and when released spring together and enter opposite ends of holes 53 or 54 which extend transversely through the ribs 46 and 48, respectively. This provides a pivotal coupling between the spring 51 and the plate assembly which allows the plane of the spring to be moved between a first position, shown in FIG. 3, in which it is disposed parallel to plate 30, and a second position shown in FIG. 1A, in which it is disposed perpendicular to the plane of plate 30. The spring is releasably held in either the first or the second position by paired perpendicularly related grooves 56, 58 and 60, 62 formed in opposite sidewalls of respective ribs which intersect holes 52 and 54, respectively.

At its other end a portion of spring 51 is bent downwardly and inwardly toward the plate assembly such that when the spring is in the position shown in FIGS. 2 and 3, the inner curved surface at 70 is spaced from the nearest edge of slot 36 by a distance corresponding to the standard lumber thickness. Accordingly, when the gripper tool is clamped at the end of elongated member 50, and the end is abutted against transverse wooden member 52, approximately half of the length of plate 30 extends beyond the end of member 50 and is supported on the transverse member, and spring 51 releasably locks the tool to transverse member 52. More particularly, in its down position the curved portion 70 of spring 51 firmly engages the outer side surface of transverse member 52 at a point about ¾-inch down from the upper edge, for locking the two members together until nailing is completed and the spring released. The spring may be "parked" in the out-of-the-way "up" position when not needed, to be available when the locking function is next desired. It will be appreciated that a locking spring can be utilized at only one end of the plate assembly at a time, and that the construction of the plate assembly is symmetrical and thus reversible with respect to arm 20 for right or left hand use. Should a particular project require use of the tool only for supporting and/or twisting an end of a lumber member, the spring may be detached from the plate assembly until again needed; if it is to be used only for twisting, the plate assembly, too, may be removed if desired.

FIGS. 5–11 illustrate a second embodiment of the gripper tool which functions in essentially the same manner as the first embodiment but differs in construction details, particularly in the construction of the levers which form the handles and jaws. One lever 100 is formed by bending mirror-image panels 102 and 104 of a stamped blank 106 of 14-gauge steel plate upwardly from the plane of the paper along parallel dotted lines 108 and 110, spaced ⅜-inch apart into perpendicularity with the plane of the paper to form an open channel member having sides corresponding in shape to panels 102 and 104 integrally joined by the strip 112 of metal lying between dotted lines 108 and 110. Strip 112 has a square aperture 114 therethrough at a location in from the larger end approximately one-third the length of blank 106, and terminates short of the other end to form separated tabs 102*a* and 104*a*. These tabs are bent toward one another in two steps, first angularly toward each other along dotted lines 103 and 105 and then along dotted lines 107 and 109 into contact with each other, as shown in FIG. 11. Aligned openings in the contacting tabs provide a hole 111 for hanging the tool.

As seen in FIG. 8, the major portion of the length of the channel member constitutes a handle 116 having at its forward end a jaw portion 118, the inner edge 118*a* of which is serrated, and an edge 120 extending at right angles from edge 118*a* a distance approximating the standard lumber thickness to a shoulder 122. The longitudinal axis of handle 116 is angularly offset by about 20° from an imaginary line extending along edge 120.

The jaw associated with handle 116 is completed by securing two jaw-shaped plates 124 and 126, best seen in FIGS. 9 and 10, to the opposite outer faces of the channel member with a pair of rivets 128 and 130 which extend through holes 132 and 134 and holes 136 and 138, respectively, which pass through both sides of the jaw portion 118 and are aligned with holes 132 and 134. The forward ends of plates 124 and 126 are secured to the channel member by a pivot pin 140 which extends through respective holes 142 and 144 in plates 126 and 124, and through an aligned hole 146 in the forward end of the channel member.

A second lever 150, shown in FIGS. 6 and 7, preferably stamped from ¼-inch thick steel plate, and then hardened, includes a handle portion 152 angularly offset by about 20° relative to a forward extending portion 154 having at its end a generally right angularly extending jaw 156, and a notched tab 158 projecting perpendicularly from handle portion 152 at approximately its junction with portion 154. Two spaced notches 160 and 162 formed in the forward edge of tab 158 serve as part of a mechanism for locking the handles together, to be described presently. The tool is assembled by inserting lever 150 between the sides of the channel member 100 with tab 50 projecting through opening 114 a short distance above the strip 112 and with an aperture 164 formed in lever 150 aligned with holes in plates 124 and 126 for receiving pivot pin 140. Handle 116 has a contoured rubber grip 170 thereon for comfortable handling, and the exposed edge of handle 150 may be coated, if desired, to improve the grip on the tool. A leaf spring 172, one end of which is secured to strip 112 with a screw 174 and the other end bent into contact with the inner edge of handle 152 causes the latter to pivot about pivot pin 140 to spread the jaws 126 and 156 apart a sufficient distance to receive a piece of standard thickness two-by-lumber between them. When the handles are squeezed together against the bias of spring 172, the jaws firmly grip opposite side surfaces of the lumber member, adjacent an edge thereof, and when locked together firmly clamp the tool to the lumber member. In this embodiment, the handles are locked together by a transverse pin 176 slidably supported in an elongated slot 178 formed in the sides of the channel member to be moved back and forth into and out of engagement with that one or other of slots 160 or 162 that provides secure clamping action.

As in the first embodiment, an integral plate-forming assembly, preferably molded from a resilient high impact plastics material, detachably secured in the throat region between the jaws 126 and 156, provides ears by which an end of a lumber member to which the tool is clamped may be temporarily supported on an abutting transverse member. Assembly 180 includes a plate 182 having a flat underside and integral spaced stiffening members 184 and 186 which extend perpendicularly upward from the top side of plate 182 and together define a slot in which the jaw assembly of plates 124 and 126 with lever arm 100 is received with a tight fit. Plate 182 is rectangular, having a width to fit snugly between the jaws and a length so as to extend to either side of the jaw assembly a distance sufficient to support a clamped lumber member on an abutting transverse member, typically ¾-inch. Aligned notches 188 and 190 located mid-width of the narrow sides of plate 182 simplify alignment of the clamped lumber member with a center line mark on the abutting member.

In common with the first embodiment, if desired the gripper tool may be locked onto an abutting member with a generally rectangular spring pivotally coupled to one or the other, or both, of stiffening members 184 and 186 for movement between a "locking" position parallel to plate 182 and an "up" position perpendicular to the plate. FIG. 11 shows a springs 192 in the "locking" position and in FIG. 9 it is in the "up" position. As seen in FIG. 10, spring 192 and the manner in which it is assembled to the plate assembly correspond in all respects to spring 51 of the first embodiment; accordingly, repetition of the description of these parts would be superfluous and is omitted. It will now be understood that the second embodiment of the tool has the same capabilities as the first and would be utilized in the manner discussed in connection with FIG. 1.

FIG. 12 illustrates a third embodiment of the gripper tool which functions in essentially the same manner as the others but differs in the respect that the handles are generally perpendicular to the throat region of the jaws. The tool 200 includes a pair of levers 202 and 204, preferably fabricated from flat hardened steel, pivotally joined by a pivot pin 206, typically 5/16-inch in diameter. The longer arm of lever 202 to one side of pivot pin is covered with a rubber grip and forms one handle 210, and the shorter arm of lever 202 defines a jaw portion 212 extending forwardly from the pivot pin and having a serrated inner edge 214 which is generally parallel to the long axis of handle 208. The longer arm of lever 204 constitutes a second handle 216 which is curved to lie closely alongside the grip on handle 210 and is offset at a location 218 slightly behind pivot pin 206 by the arm thickness, typically 3/16-inch, such that handles 210 and 216 are substantially coplanar. The shorter arm 220 of lever 204 has a jaw portion 222 extending from pivot pin 206 in a direction generally parallel to the inner edge 214 of the other jaw; the inner edge 224 of the jaw portion is serrated and is spaced from the opposing jaw a distance approximating the standard thickness of two-by-lumber. The shorter arm 212 of lever 202 has an edge 226 which is perpendicular to the opposing jaws and defines a throat region between them. As in the first embodiment, the thickness of the jaw portions is doubled by securing plates 228 and 230 to the near surface of jaw 214 and to the far surface of jaw 222, respectively, each of which extends from a point just below edge 226 and to the tip of the jaw.

When handle 216 is biased away from handle 210 by a spring 232 secured at one end by pivot pin 206, the jaw spacing is such as to closely receive a standard thickness lumber member 234 therebetween, and when they are squeezed together, against the bias of the spring, the jaws close and firmly grip opposite side surfaces of the member. A knob 208*a* formed at the distal end of rubber grip 208 and the essentially matching curvature of handle 216 enable the user to press the handles together and at the same time, with the same hand, to comfortably lift lumber member 234 vertically for transport and to hold it in position for nailing. If desired, a locking mechanism (not shown) may be provided for locking the distal ends of the handles together.

To provide ears for enabling the tool to temporarily support an end of a joist on a transverse member in position for nailing, a flat steel plate 236, typically ¼-inch thick, extends substantially equidistantly to either side of and at right angles to the shorter arms and is affixed, as by welding, to edge 226 of arm 212.

It will now be evident to one skilled in the art that various changes may be made in the invention, and that the invention may be used in ways other than those described, without departing from the spirit and scope thereof. For example, the plate which forms the ears need not be rectangular in shape, the only requirement being that it extend a sufficient distance to either side of the jaws, and be strong enough, to support one end of a wooden lumber member of lengths typically used for framing. Also, the handles of the tool may differ in details from the constructions shown, including the use of different materials and fabrication methods. Therefore, the invention is not limited by that which is shown in the drawings and described in the specification, but only as indicated in the appended claims.

I claim:

1. A gripper tool for facilitating the handling of a 2-by-lumber member of rectangular cross-section having a nominal thickness of 1½ inches, comprising:

a pair of levers pivotally joined by a pivot pin having arms at one side of the pivot pin constituting handles which are disposed generally parallel to each other and in a substantially common plane, and shorter arms at the other side of the pivot pin which are disposed in closely adjacent planes, a first of said shorter arms including a portion which extends forwardly from said pivot pin and at a forward end has a generally right angularly extending first jaw, and the second of said shorter arms extending forwardly from said pivot pin and having a second jaw thereon which opposes and is spaced from said first jaw by a throat region of a length substantially equal to said nominal thickness, said jaws being adapted to grip opposite side surfaces of a portion of a lumber member having a rectangular cross-section and said nominal thickness placed therebetween when said handles are squeezed toward one another, and means defining a flat plate affixed to said extending portion of said first of said shorter arms at said throat region, said plate having a width dimension generally corresponding to said nominal thickness and a length dimension approximately twice said width dimension and extending substantially equidistantly to either side of and right angularly to the plane of said first of said shorter arms for providing ears adapted for temporarily supporting an end of a lumber member gripped by said jaws on an abutting lumber member.

2. A gripper tool as defined by claim 1, wherein said plate-defining means is removably secured to said extending portion of said first of said shorter arms, and wherein said handles have releasable locking means thereon for locking said handles together for temporarily clamping said jaws to said lumber member.

3. A gripper tool as defined by claim 2, wherein said plate-defining means includes means for removably securing said plate-defining means comprising a pair of parallel spaced arms integral with and disposed perpendicularly to the plane of said plate and adapted to receive therebetween with a tight fit said extending portion of said first of said shorter arms.

4. A gripper tool as defined by claim 3, wherein said plate-defining means and integral spaced arms are formed of molded resilient plastics material for enabling said plate-defining means to be slid onto and snapped off from said extending portion.

5. A gripper tool as defined by claim 3, wherein said gripper tool further comprises a flat generally rectangularly-shaped spring pivotally coupled along a narrow side thereof to one of said spaced arms for angular movement between a first position in which the plane of the spring is perpendicular to said plate and a second position in which the plane of the spring is substantially parallel to the plane of said plate, wherein said spring is shaped and dimensioned to lock said gripper tool, when clamped at an end of a first lumber member having said nominal thickness and said spring is disposed in said second position, onto an abutting second lumber member having said nominal thickness.

6. A gripper tool as defined by claim 2, wherein said gripper tool further comprises a flat generally rectangularly-shaped spring pivotally coupled to said plate defining means for releasably locking said gripper tool clamped at an end of a first lumber member onto a transverse abutting lumber member of said nominal thickness.

7. A gripper tool as defined by claim 1, wherein said handles are angularly displaced from said extending portion of said first of said shorter arms by a predetermined angle which reduces wrist fatigue of the user.

8. A gripper tool as defined by claim 7, wherein a long axis of the handle joined to said first of said shorter arms is angularly displaced by approximately 20° from an imaginary line extending along the throat region between said jaws.

9. A gripper tool as defined by claim 1, wherein a first of said pair of levers comprises an elongated channel-shaped member including a first handle portion and a generally right-angularly extending first jaw, wherein a second of said levers comprises an elongated flat member disposed within the channel of said channel-shaped member and including a second handle portion angularly offset relative to a forwardly extending portion having at its end a generally right angularly extending second jaw, and wherein said second lever is joined to said channel member for pivotal movement relative thereto.

10. A gripper tool as defined by claim 9, wherein said handle portions have locking means thereon for releasably locking said handles in clamping relationship with a lumber member, and wherein said locking means comprises the combination of a notched tab integral with said elongated flat member which projects from said channel member and has at least one notch thereon and a transverse pin slidably supported in an elongated slot formed in said channel member for movement into and out of engagement with said at least one notch on said tab.

11. A gripper tool as defined by claim 1, wherein a long axis of the handle joined to said first of said shorter arms is angularly displaced by 90° from an imaginary line extending along the throat region between said jaws.

12. A gripper tool as defined by claim 1, wherein said flat plate is rigidly secured to said extending portion of said first of said shorter arms.

13. A gripper tool for improving safety in the handling of a lumber member of rectangular cross-section having a nominal thickness of 1½ inches, comprising:

first and second levers joined by a pivot pin for pivotable movement relative to each other, said levers having longer arms at one side of the pivot pin constituting handles having generally parallel longitudinal axes disposed in a substantially common plane, and shorter arms at the other side of the pivot pin which are disposed in closely adjacent planes, a first of said shorter arms including a portion which extends forwardly from said pivot pin and at its forward end has a generally right-angularly extending first jaw, and the second of said shorter arms extending from said pivot pin and defining a second jaw disposed generally parallel to and spaced from said first jaw by a throat region of a length substantially equal to said nominal thickness;

said jaws being adapated to grip opposite side surfaces of a portion of a lumber member placed therebetween when said handles are squeezed toward one another, said handles having means thereon for locking said handles together for releasably clamping said jaws to said lumber member; and means defining a flat plate adapted to be removably secured to the said first of said shorter arms at said throat region and extending substantially equidistantly to either side of and right angularly to the plane of said first of said shorter arms, said flat plate providing, when said gripper tool is clamped closely adjacent an end of said lumber member, ears for temporarily supporting said end upon an abutting transverse lumber member.

14. A gripper tool as defined by claim 13, wherein the longitudinal axes of said handles are angularly displaced from an imaginary line extending along the edge of said throat region by a predetermined angle which reduces wrist fatigue of the user.

15. A gripper tool as defined by claim 14, wherein said predetermined angle is substantially 20°.

16. A gripper tool as defined by claim 13, wherein said plate-defining means includes means for removably securing said plate to said first of said shorter arms, said securing means comprising a pair of spaced members integral with and extending perpendicularly from the plane of said plate and dimensioned to tightly grip opposite side surfaces of said extending portion of said first of said shorter arms.

17. A gripper tool as defined by claim 16, wherein said plate-defining means and integral spaced members are made of a molded plastics material which is sufficiently resilient that said spaced members can be slid on and snapped off yet tightly grip opposite side surfaces of said extending portion when in place thereon.

18. A gripper tool as defined by claim 17, wherein said plate is rectangular in shape, having a width dimension substantially equal to said nominal lumber thickness and a length dimension approximately twice said nominal thickness.

19. A gripper tool as defined by claim 17, wherein said gripper tool further comprises a flat generally rectangularly-shaped spring pivotally coupled along a narrow side thereof to one of said spaced members for angular movement between a first position in which it is generally parallel to said spaced members and a second position in which it is substantially parallel to the plane of said plate, said spring being shaped and dimensioned for locking the gripper tool, when clamped closely adjacent an end of a first lumber member having said nominal thickness and said spring is in said second position, onto an abutting second lumber member having said nominal thickness.

20. A gripper tool for facilitating handling of a lumber member of rectangular cross-section having a predetermined thickness, comprising:

a pair of levers pivotally joined by a pivot pin having arms at one side of the pivot pin constituting handles which are disposed generally parallel to each other and in a substantially common plane, and shorter arms at the other side of the pivot pin which are disposed in closely adjacent planes, a first of said shorter arms including a portion which extends forwardly from said pivot pin and at its forward end has a generally right angularly extending first jaw, and the second of said shorter arms extending forwardly from said pivot pin and having a second jaw thereon which opposes and is spaced from said first jaw by a throat region having a length substantially equal to said predetermined thickness, said jaws being adapted to grip opposite side surfaces of a lumber member of rectangular cross-section placed therebetween when said handles are squeezed toward one another, and means defining a plate removably secured to said extending portion of said first of said shorter arms at said throat region, said plate having a width dimension corresponding to the spacing between said jaws and extending substantially equidistantly to either side of and right angularly to the plane of said first of said shorter arms for providing ears adapted for temporarily supporting an end of a lumber member gripped by said jaws on an abutting lumber member, said handles having releasable locking means thereon for locking said handles together for temporarily clamping said jaws to said lumber member.

* * * * *